US008037579B2

(12) United States Patent
Tomasetti

(10) Patent No.: US 8,037,579 B2
(45) Date of Patent: Oct. 18, 2011

(54) CABLE TIE SLEEVE

(75) Inventor: Kenneth Tomasetti, Phillipston, MA (US)

(73) Assignee: Advanced Cable Ties, Inc., Gardner, MA (US)

( * ) Notice: Subject to any disclaimer, the term of this patent is extended or adjusted under 35 U.S.C. 154(b) by 1028 days.

(21) Appl. No.: 11/861,404

(22) Filed: Sep. 26, 2007

(65) Prior Publication Data

US 2009/0077772 A1 Mar. 26, 2009

(51) Int. Cl.
*B65D 67/02* (2006.01)
*B65D 63/10* (2006.01)
*B65D 63/12* (2006.01)

(52) U.S. Cl. ..... 24/16 PB; 24/17 R; 24/17 AP; 24/30.5 R

(58) Field of Classification Search ..... 24/16 PB, 24/17 AP, 30.5 R
See application file for complete search history.

(56) References Cited

U.S. PATENT DOCUMENTS 3,197,829 A * 8/1965 Caveney et al. ..... 24/16 PB
3,384,700 A * 5/1968 Mier et al. ..... 174/5 R
3,762,585 A * 10/1973 Hobbs et al. ..... 294/74
5,263,231 A 11/1993 Sorenson et al.
5,440,786 A 8/1995 Sorenson et al.
5,615,455 A 4/1997 Sorenson et al.
5,964,013 A 10/1999 Bergstrom
6,128,809 A 10/2000 Khokhar
6,311,935 B1 11/2001 Mullen, Jr.
6,499,199 B2 * 12/2002 Frazier ..... 24/306
6,698,069 B2 * 3/2004 Caveney et al. ..... 24/16 PB
6,895,641 B1 * 5/2005 Savicki ..... 24/30.5 R
7,107,653 B2 * 9/2006 Thompson ..... 24/16 PB
7,127,779 B2 * 10/2006 Hewes ..... 24/16 PB
7,263,745 B2 * 9/2007 Mori ..... 24/16 PB
2004/0006852 A1 * 1/2004 Castro ..... 24/30.5 R
2004/0045134 A1 * 3/2004 Savicki ..... 24/30.5 R
2006/0053753 A1 * 3/2006 Ha et al. ..... 53/482

* cited by examiner

*Primary Examiner* — Robert Sandy
*Assistant Examiner* — Tyler Johnson
(74) *Attorney, Agent, or Firm* — Brian M. Dingman; Mirick, O'Connell, DeMallie & Lougee, LLP

(57) ABSTRACT

A sleeve adapted to be placed over a cable tie, in which the cable tie has an elongated flexible strap, a locking head coupled to the strap, and structure carried by the strap that is adapted to be engaged with the head to lock the strap and head together. The sleeve has an elongated body that defines an open-ended longitudinal cavity that is sized and shaped to accept the strap, so that the sleeve can be removably engaged along the length of the strap, and a pair of spaced protrusions extending from the body so as to define a receiving recess located between the protrusions and the sleeve body.

18 Claims, 4 Drawing Sheets

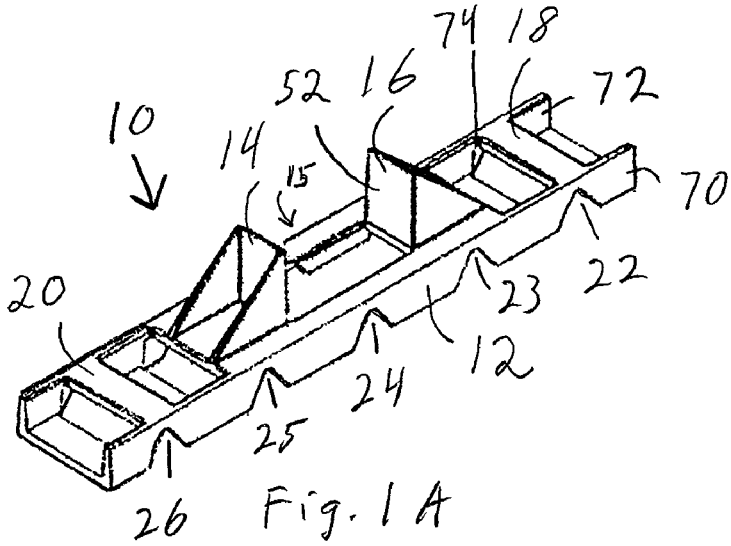
Fig. 1A
Fig. 1B
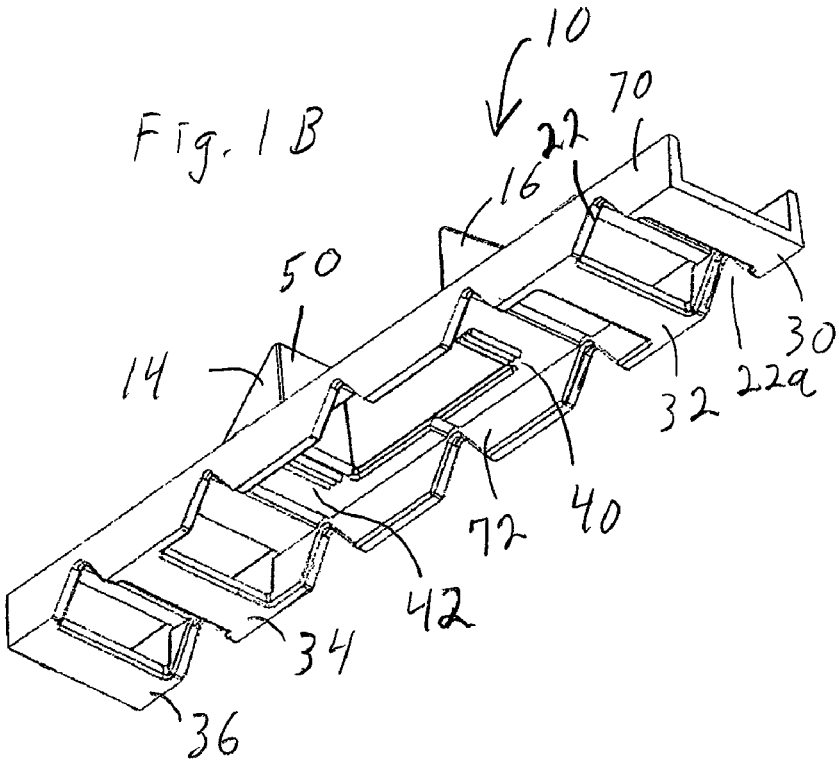

CABLE TIE SLEEVE

FIELD OF THE INVENTION

This invention relates to cable ties.

BACKGROUND OF THE INVENTION

Cable ties are useful for quickly and securely retaining together two or more items, for example the conductors in a wiring harness. Several examples of cable ties are shown in U.S. Pat. Nos. 5,263,231; 5,440,786; and 5,615,455. In a general sense, many cable ties are essentially an elongated tongue with a tip at one end and a locking head at the other end. A series of ratchet teeth is located on the underside of the tongue. The locking head has an integral movable pawl that is hinged at one side of an opening in the locking head. When the tip is inserted in the opening and pulled through the head, the pawl engages with the ratchet teeth to prevent the tip from being pulled back out of the opening.

When a cable tie is used to hold a cable or a brake line or the like in place against another structure, the cable tie is tightened sufficiently for the needs of the situation. This causes a compressive force on the cable or line being held, which can compromise the cable or line. For example, if an electric or fiber optic cable is being held on the outside of a conduit or the like, the compressive force can pinch or tear the cable, which would compromise the cable's integrity. Also, cable ties are sometimes used to hold hydraulic brake lines in place against the underside of a motor vehicle. Flexing and vibration of the motor vehicle undercarriage causes a variation in the compressive stress placed on the line by the cable tie. This can cause the tie to pinch the line so as to cause leakage, or even a break, either of which is entirely unacceptable.

SUMMARY OF THE INVENTION

It is therefore an object of this invention to provide a sleeve for use on a cable tie that will then hold a cable, line or the like in place against another structure without compressing, binding or chaffing the cable or line.

It is a further object of this invention to provide such a cable tie sleeve in which two or more cables or lines can be held in place in this manner.

This invention features a sleeve adapted to be placed over a cable tie, in which the cable tie comprises an elongated flexible strap, a locking head coupled to the strap, and structure carried by the strap that is adapted to be engaged with the head to lock the strap and head together, the sleeve comprising an elongated body that defines an open-ended longitudinal cavity that is sized and shaped to accept the strap, so that the sleeve can be removably engaged along the length of the strap, and a pair of spaced protrusions extending from the body so as to define a receiving recess located between the protrusions and the sleeve body.

Each protrusion may comprise a wall that extends at about 90 degrees from the body, to define a receiving recess with essentially parallel walls. At least one of the protrusions may define a generally triangular shape when viewed from the side. The body cavity may be generally rectangular in cross-section. The sleeve body may comprise two elongated generally parallel sidewalls. The sidewalls may have a top and a bottom edge, and the sleeve body may further comprise a top wall coupled to the top edges of both of the sidewalls. The protrusions may be coupled to the top wall. The top wall may comprise at least two spaced top straps. The sleeve body may further comprise a bottom wall coupled to the bottom edges of both of the sidewalls. The bottom wall may comprise two or more spaced bottom straps.

Each of the sidewalls may define one or more openings; there are typically two or more spaced openings. The openings may be generally triangular in shape. The base of the triangular openings may be at the bottom of the sidewalls. The openings on each sidewall may be generally aligned in the direction across the elongated cavity, to define bending regions across the top. The bending regions may be further defined by thinnings of the top to create living hinges in the top. The living hinges may be essentially perpendicular to the sidewalls. The top may comprise a series of spaced top straps. The hinges may be located at approximately the midpoints of the top straps. The top may define a series of closely-spaced, essentially parallel, inwardly-directed protrusions on its underside. The elongated flexible strap of the cable tie may define spaced teeth across the width of the strap, and the inwardly-directed protrusions may be spaced apart about the same distance as are the teeth, so that the sleeve releasably engages with the strap.

Featured in another embodiment is a sleeve adapted to be placed over a cable tie, in which the cable tie comprises an elongated flexible strap, a locking head coupled to the strap, and structure carried by the strap that is adapted to be engaged with the head to lock the strap and head together, the sleeve comprising an elongated body that comprising two elongated generally parallel sidewalls and a top wall coupled to both sidewalls, to define an open-ended longitudinal cavity that is generally rectangular in cross-section and sized and shaped to accept the strap, so that the sleeve can be removably engaged along the length of the strap. The sidewalls each define two or more spaced openings, with the openings on each sidewall being generally aligned in the direction across the elongated cavity, to define bending regions across the top. There is a pair of spaced protrusions extending from the top of the body so as to define a receiving recess located between the protrusions and the sleeve body. Each the protrusion may comprise a wall that extends at about 90 degrees from the body, to define a receiving recess with essentially parallel walls.

The bending regions may be further defined by thinnings of the top to create living hinges in the top. The living hinges may be essentially perpendicular to the sidewalls. The top may comprise a series of spaced top straps. The hinges may be located at approximately the midpoints of the top straps. The top may define a series of closely-spaced, essentially parallel, inwardly-directed protrusions on its underside. The elongated flexible strap of the cable tie may define spaced teeth across the width of the strap, and the inwardly-directed protrusions may be spaced apart about the same distance as are the teeth, so that the sleeve releasably engages with the strap.

BRIEF DESCRIPTION OF THE DRAWINGS

Other objects, features and advantages will occur to those skilled in the art from the following description of the preferred embodiments, and the accompanying drawings, in which:

FIG. 1A is a top perspective view of a preferred embodiment of the cable tie sleeve of the invention;

FIG. 1B is a bottom perspective view of the cable tie sleeve of FIG. 1A;

DETAILED DESCRIPTION OF THE PREFERRED EMBODIMENTS

The invention may be accomplished in a sleeve for a cable tie, in which the sleeve is removeably coupled to the cable tie and can be located essentially anywhere along the length of the tie. The sleeve carries a pair of protrusions that extend outward from the strap of the cable tie to define a recess located between the protrusions. A cable or other structure such as a motor vehicle brake line can be located in the recess. The inventive sleeve thus helps to maintain a cable, brake line or other elongated structure in place while helping to alleviate the compressive force that would otherwise be placed on the structure by the tightened cable tie.

Figure 1C:
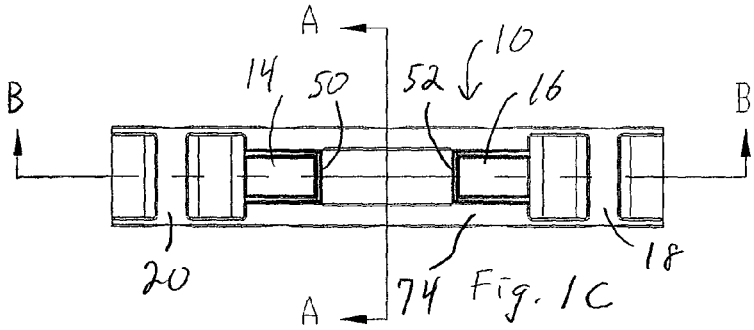
FIG. 1C is a top plan view of the cable tie sleeve of FIGS. 1A and 1B.
Figure 1F:
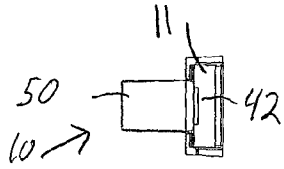
FIG. 1F is a cross-sectional view of the cable tie sleeve of FIGS. 1A-1E taken along line A-A of FIG. 1C.
Figure 1D:
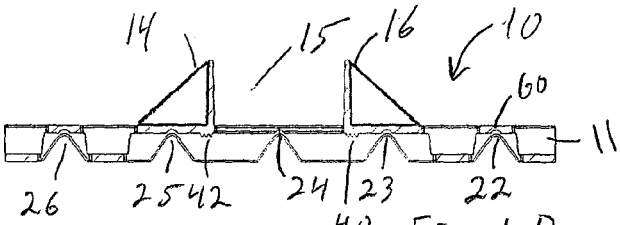
FIG. 1D is a cross-sectional view of the cable tie sleeve of FIGS. 1A-1C taken along line B-B of FIG. 1C.
Figure 1G:
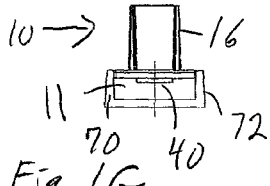
FIG. 1G is an end view of the cable tie sleeve of FIGS. 1A-1F.
Figure 1E:
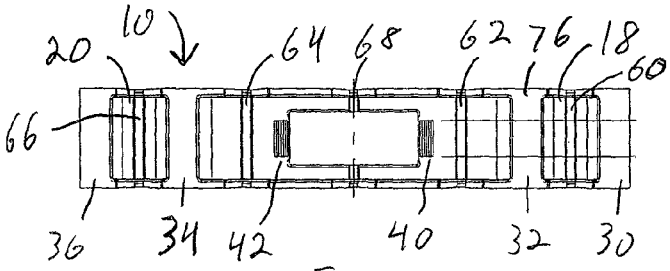
FIG. 1E is a bottom plan view of the cable tie sleeve of FIGS. 1A-1D.
Figure 2A:
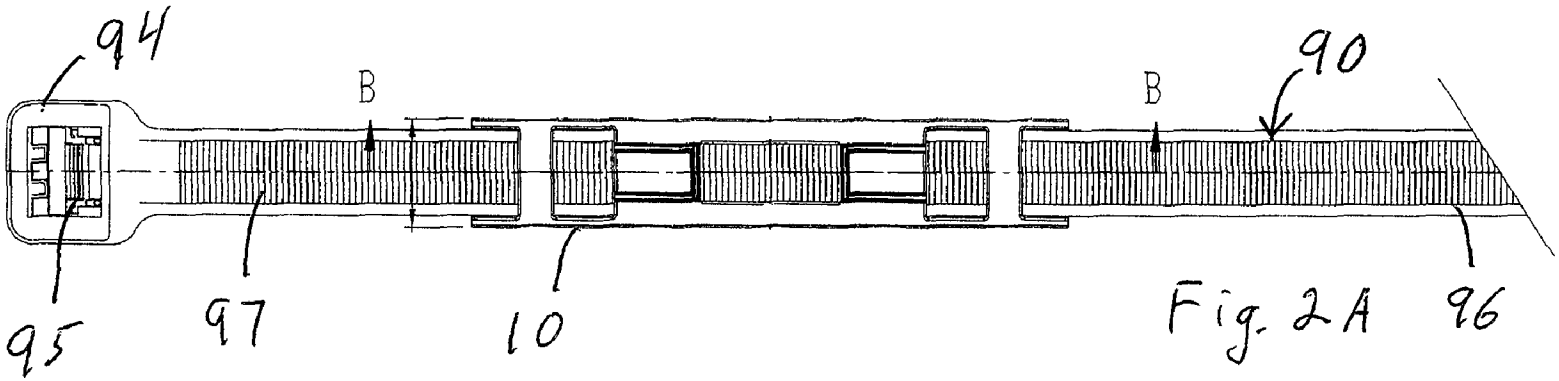
FIG. 2A is a top view of the cable tie sleeve of FIGS. 1A-1G engaged with a cable tie.
Figure 2B:
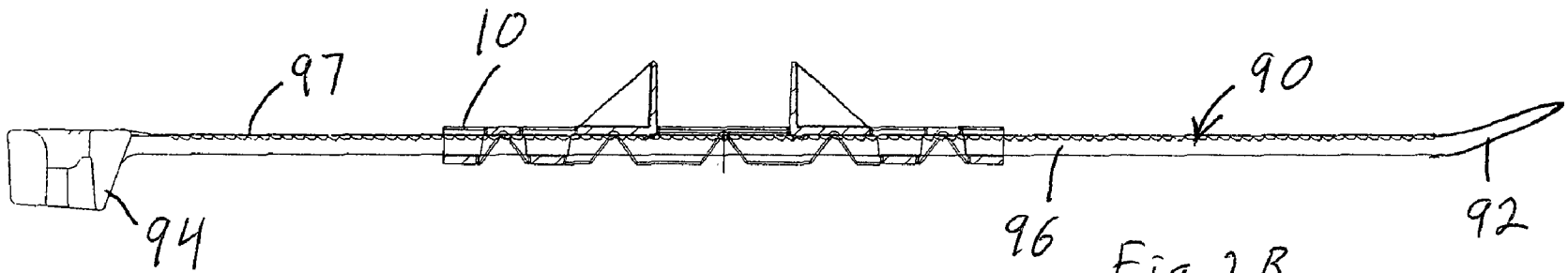
FIG. 2B is a cross-sectional view of the cable tie and sleeve of FIG. 2A, taken along line B-B of FIG. 2A.
Figure 3:
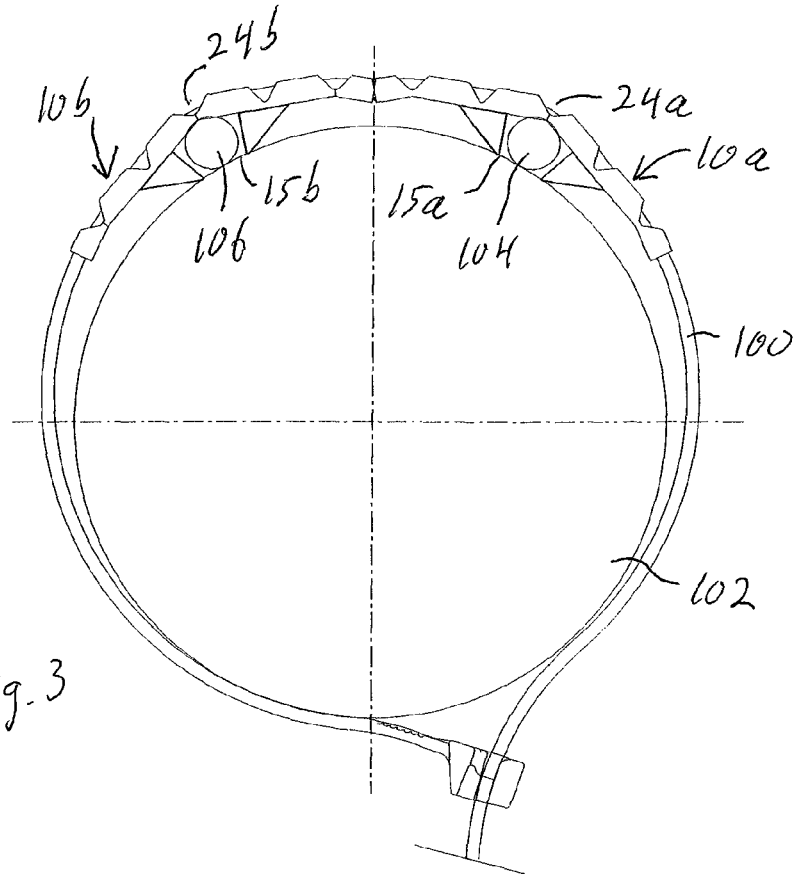
FIG. 3 is an end view of two adjacent cable tie sleeves engaged with a single cable tie in place holding two brake lines on a drive shaft, as one example of the use of the invention.
Figure 4:
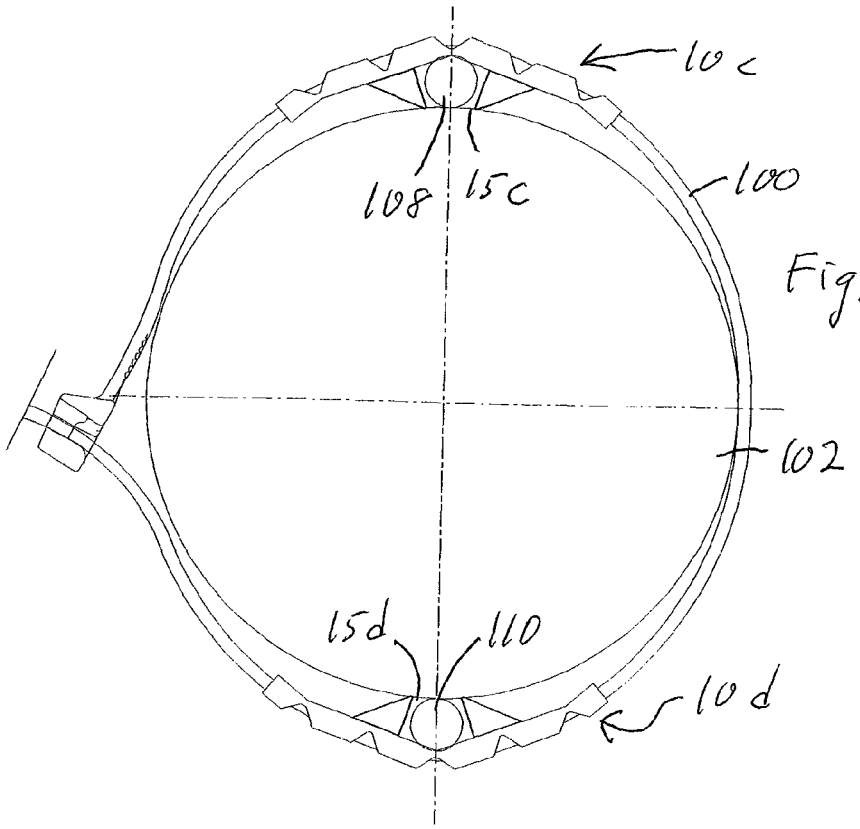
FIG. 4 is a view similar to that of FIG. 3, but showing two non-adjacent cable tie sleeves in use holding two spaced electrical cables against a duct.

FIGS. 1A through 1G detail the construction of the preferred embodiment of the cable tie sleeve of the invention. Sleeve 10 is adapted to be placed over a cable tie, as shown in FIGS. 2 through 4. Cable tie 90 shown in FIGS. 2A and 2B is a typical cable tie with an elongated flexible strap 96 with a locking head 94 at one end of strap 96 and tail 92 at the other end. Strap 96 carries structure that is adapted to be engaged with locking head 94 to lock cable tie 90 in a generally circular shape. In this embodiment, cable tie 90 defines a large number of closely-spaced transverse teeth 97 across most of the width of the strap, and head 94 carries locking pawl 95 that has one or more teeth that engage with teeth 97 on strap 96. The construction of cable ties is well known and need not be further described. It should be noted, however, that there are many different types of cable tie locking arrangements, and this invention can be used with many such cable ties, as will be more fully explained below.

Cable tie sleeve 10, FIGS. 1A through 1G, comprises elongated body 12 that defines an open-ended longitudinal cavity 11 that is sized and shaped to accept the strap of a cable tie. This allows the sleeve to be slipped over the end of the cable tie and moved along the length of the tie strap. Sleeve 10 carries a pair of spaced protrusions 14, 16, extending from body 12 so as to define receiving recess 15 between the protrusions. Ideally, recess 15 is sized and shaped to accept a structure that is to be held down by the cable tie with the inventive sleeve. For example, in one non-limiting embodiment, a sleeve about 2.1 inches long, 0.4 inches wide, and 0.4 inches high defines a recess cavity about 0.3 inches wide and 0.2 inches high, which is useful to maintain in place without compressing structures such as brake cables.

In the embodiment shown in these figures, each protrusion comprises a wall that extends at about 90 degrees from the sleeve body. This defines a receiving recess with essentially parallel walls. For example, protrusion 14 has generally vertical interior wall 50 and protrusion 16 has generally vertical interior wall 52. Protrusions 14 and 16 in this embodiment also comprise spaced essentially triangular side walls that give the protrusion compressive and bending strength sufficient to prevent the protrusions from being crushed by the typical cable tie compressive force accomplished by the cable tie on which the sleeve is designed to fit.

Most cable tie straps have a generally rectangular shape, dictating that longitudinal cavity 11 also be generally rectangular in cross-section. This is accomplished in the embodiment by forming elongated body 12 with two elongated generally parallel side walls 70 and 72, a top wall 74 coupled to the top edges of both of the side walls, and a bottom wall 76 coupled to the bottom edges of both of the side walls.

As cable ties take a generally circular shape when they are locked in place, the inventive sleeve needs to be able to flex or bend such that its elongated body generally follows the curvature of the portion of the cable ties strap with which the sleeve is engaged. This could be accomplished in different manners. One manner would be to make the body of a material having sufficient flexibility, perhaps a relatively low durometer material such as a silicone rubber or the like. This construction might require that the protrusions be made of a harder material, or perhaps require inclusion of stiffening structures in the protrusions, such as might be accomplished by insert molding stiffer plastic or metal pieces, perhaps.

Most cable ties are made from a tough nylon material. An inventive sleeve that is fully compatible with such ties can be made from the same material. In order to assist the inventive sleeve to bend generally along the same radius as the cable tie strap, it is desirable to place one or more relief openings in the sleeve body sidewalls. In the preferred embodiment shown in the drawings, this relief is accomplished by a series of generally triangular openings in each sidewall, in which the openings are generally aligned in the direction across the elongated cavity. This defines bending regions across the top of the elongated body. For example, side 70, FIG. 1A, includes openings 22 through 26. Side 72, FIG. 1B includes identical openings at the same locations. Only one of these openings 22*a* is labeled, for the sake of clarity in the drawing. These aligned openings define bending regions across top wall 74. These bending regions are located generally at the linear areas at which the top of the triangular openings intersect the top wall of the elongated body. These areas are labeled areas 60, 62, 68, 64 and 66, FIG. 1E. In this embodiment, the bending at these areas is further enhanced by creating living hinges across the width of the top at each of these areas. This is accomplished by thinning the plastic in such areas by creating a small semi-circular molded depression in the underside the top at these areas. These depressions are visible in the cross-sectional view of FIG. 1D, with depression 60 being labeled.

Another aspect that assists in the flexibility of the inventive sleeve is constructing both the top and bottom walls of the elongated body as a series of spaced straps. Another way to look at this construction is that most of the area of the top and bottom walls is open. In fact, the top and bottom walls need only to be sufficiently structural such that they maintain the viability of the sleeve as it is used and bent. Top wall 74 in this construction comprises spaced straps 18 and 20, together with the pedestals that support protrusions 14 and 16. Bottom wall 76 comprises four straps 30, 32, 34 and 36. It is believed that the functionality of the elongated body could be achieved with a minimum of three such straps, pedestals or other connecting regions, with two on the top wall (one supporting each protrusion) and one on the bottom wall. The exact design and construction of the elongated body should be such as to allow the sleeve to be bend sufficiently so as not to substantially inhibit the functionality of the cable tie with which it is engaged, while providing the protrusions with sufficient resistance to compression to achieve the functionality of at least inhibiting, and ideally eliminating, compressive forces placed on the cable or other structure that is located in the recess of the inventive cable tie sleeve.

The preferred embodiment of the cable tie sleeve of the invention includes structure that helps to maintain the cable tie in place at the desired location along the length of the cable tie strap. In the preferred embodiment that is designed to be used with a cable tie strap having a number of transverse teeth, this objective is accomplished by including at least one series of closely-spaced, essentially parallel, inwardly-directed protrusions on the underside of the top of the sleeve. In the embodiment, two such series of spaced protrusions, 40 and 42, are included. Each such series comprises three protrusions that define between them two receiving spaces for receiving two adjacent teeth of the cable tie strap. The protrusions of series 40 and 42 are dimensioned to accomplish an interference fit with the teeth of a cable tie strap, the interference fit being able to be overcome with a longitudinal pushing or pulling force that allows the cable tie sleeve to be located at a desired point along the length of the cable tie strap, but with sufficient staying force such that the cable tie sleeve won't move along the length of the strap as the cable tie is engaged around a structure such as a duct or vehicle axle or the like.

FIGS. 3 and 4 show two of the numerous possibilities of the inventive cable tie sleeve. One aspect of these illustrations is that one or more cable tie sleeves can be placed on a cable tie. Another aspect is that the cable tie sleeves can be located where desired along the length of the cable tie strap, in order to accommodate the mounting needs being met by the cable tie sleeves. FIG. 3 shows cable tie 100 engaged around structure 102 to hold cables or brake lines 104 and 106 in place against structure 102 without crushing them. This illustration also shows that cable ties 10*a* and 10*b* tend to bend more at the central living hinges 24*a* and 24*b*, respectively, due to the fact that the construction of the elongated body is such that in the area of recesses 15*a* and 15*b* defined between the protrusions, both the top and bottom walls of the elongated body of the cable tie sleeves is essentially open. This makes this portion of the length of the cable tie sleeves more easily bent than the other portions of the length.

These drawings also show that this bending acts to cant the triangular protrusions toward one another at the point where they contact structure 102. This causes the shape of the receiving recess such as recess 15*a* to change such that the top opening of the recess becomes effectively smaller as the sleeve is bent. This change causes the sidewalls of the recess to be generally inwardly directed such that they more closely follow the circumference of the round structures 104 and 106. The result is that for structures that generally fill the recess, the generally vertical walls of the protrusions become angled such that they can support or at least more closely restrain the sides of the cables. This construction provides additional crush resistance, as the protrusions lie generally perpendicular to the surface, thus accomplishing the greatest resistance to crushing forces.

Finally, FIG. 4 illustrates a case in which again multiple inventive cable tie sleeves are used, but this time they are spaced along the length of the cable tie strap rather than adjacent to one another to accommodate the diametrically opposed cables 108 and 110 that are held within recesses 15*c* and 15*d* of cable tie sleeves 10*c* and 10*d*, respectively.

Although features of this invention are shown in some drawings and not others, this is not a limitation of the invention, which is defined by the following claims. Also, other embodiments would be apparent to those skilled in the art from the description, and the following claims.

What is claimed is:

1. A sleeve adapted to be placed over a cable tie, in which the cable tie comprises an elongated flexible strap, the sleeve comprising:

an elongated body defining a generally parallelepiped external shape and an open-ended, rectangular-shaped longitudinal cavity that is sized and shaped to accept the strap, so that the sleeve can be engaged along the length of the strap, the elongated body comprising two parallel sidewalls, each sidewall having a rectangular shape and defining a top edge and an opposing bottom edge, a top wall coupled to the top edges of both of the sidewalls and perpendicular to the sidewalls, wherein the top wall comprises at least two spaced top straps, and a bottom wall coupled to the bottom edges of both of the sidewalls and perpendicular to the sidewalls; and a pair of spaced protrusions, where each protrusion protrudes from the top wall and comprises a protruding wall that is perpendicular to the top wall such that the protruding walls are parallel to each other so as to define a receiving recess located between the protruding walls.

2. The sleeve of claim 1, wherein the top wall defines at least one series of closely-spaced, essentially parallel, inwardly-directed protrusions on its underside.

3. The sleeve of claim 2, wherein the elongated flexible strap of the cable tie defines spaced teeth across the width of the strap, and the inwardly-directed protrusions are spaced apart about the same distance as are the teeth, so that the sleeve releasably engages with the strap.

4. A sleeve adapted to be placed over a cable tie, in which the cable tie comprises an elongated flexible strap, the sleeve comprising:

an elongated body defining a generally parallelepiped external shape and an open-ended, rectangular-shaped longitudinal cavity that is sized and shaped to accept the strap, so that the sleeve can be engaged along the length of the strap, the elongated body comprising two parallel sidewalls, each sidewall having a rectangular shape and defining a top edge and an opposing bottom edge, a top wall coupled to the top edges of both of the sidewalls and perpendicular to the sidewalls, and a bottom wall coupled to the bottom edges of both of the sidewalls and perpendicular to the sidewalls, wherein the bottom wall comprises two or more spaced bottom straps, and a pair of spaced protrusions, where each protrusion protrudes from the top wall and comprises a protruding wall that is perpendicular to the top wall such that the protruding walls are parallel to each other so as to define a receiving recess located between the protruding walls.

5. A sleeve adapted to be placed over a cable tie, in which the cable tie comprises an elongated flexible strap. the sleeve comprising:

an elongated body defining a generally parallelepiped external shape and an open-ended, rectangular-shaped longitudinal cavity that is sized and shaped to accept the strap, so that the sleeve can be engaged along the length of the strap, the elongated body comprising two parallel sidewalls, each sidewall having a rectangular shape and defining a top edge and an opposing bottom edge, wherein the sidewalls each define two or more spaced openings, a top wall coupled to the top edges of both of the sidewalls and perpendicular to the sidewalls, and a bottom wall coupled to the bottom edges of both of the sidewalls and perpendicular to the sidewalls; and a pair of spaced protrusions, where each protrusion protrudes from the top wall and comprises a protruding wall that is perpendicular to the top wall such that the protruding walls are parallel to each other so as to define a receiving recess located between the protruding walls.

6. The sleeve of claim 5, wherein the openings are generally triangular in shape.

7. The sleeve of claim 6, wherein each of the triangular openings comprises a base, and the base of the triangular openings is at the bottom of the sidewalls.

8. The sleeve of claim 5, wherein the openings on each sidewall are generally aligned in the direction across the elongated body, to define bending regions across the top wall.

9. The sleeve of claim 8, wherein the bending regions are further defined by thinnings of the top to create living hinges in the top wall.

10. The sleeve of claim 9, wherein the living hinges are essentially perpendicular to the sidewalls.

11. The sleeve of claim 10, wherein the top wall comprises a series of spaced top straps.

12. The sleeve of claim 11, wherein the hinges are located at approximately the midpoints of the top straps.

13. A sleeve adapted to be placed over a cable tie, in which the cable tie comprises an elongated flexible strap the sleeve comprising:

an elongated body defining a generally parallelepiped external shape and an open-ended, rectangular-shaped longitudinal cavity that is sized and shaped to accept the strap, so that the sleeve can be removably engaged along the length of the strap, the elongated body comprising two parallel sidewalls, each sidewall having a rectangular shape and defining a top edge and a bottom edge, and wherein the sidewalls each define two or more spaced openings, with the openings on each sidewall being generally aligned in the direction across the elongated body to define bending regions across the top, a top wall coupled to the edges of both the sidewalls and perpendicular to the sidewalls, and a bottom wall coupled to the bottom edges of both of the sidewalls and perpendicular to the sidewalls; and a pair of spaced protrusions, where each protrusion protrudes from the top wall and comprises a protruding wall that is perpendicular to the top wall such that the protruding walls are parallel to each other so as to define a receiving recess located between the protrusions and the sleeve body.

14. The sleeve of claim 13, wherein the bending regions are further defined by thinnings of the top wall to create living hinges in the top wall, wherein the living hinges are essentially perpendicular to the sidewalls.

15. The sleeve of claim 14, wherein the top wall comprises a series of spaced top straps.

16. The sleeve of claim 15, wherein the hinges are located at approximately the midpoints of the top straps.

17. The sleeve of claim 16, wherein the top wall defines a series of closely-spaced, essentially parallel, inwardly-directed protrusions on its underside.

18. The sleeve of claim 17, wherein the elongated flexible strap of the cable tie defines spaced teeth across the width of the strap, and the inwardly-directed protrusions are spaced apart about the same distance as are the teeth, so that the sleeve releasably engages with the strap.

* * * * *